US005121943A

United States Patent [19]

Proctor et al.

[11] Patent Number: 5,121,943

[45] Date of Patent: Jun. 16, 1992

[54] SKI POLE HANDLE

[76] Inventors: Christopher S. Proctor, 716 Kitchawan Rd., Ossining, N.Y. 10562; Andrew N. Bazos, 316 W. 102nd St., Apt. 1A, New York, N.Y. 10025

[21] Appl. No.: 470,783

[22] Filed: Jan. 26, 1990

[51] Int. Cl.[5] ..... A63C 11/22

[52] U.S. Cl. ..... 280/821

[58] Field of Search ..... 280/821, 822, 819, 816; 135/65, 66

[56] References Cited

U.S. PATENT DOCUMENTS

| | | | |
|---|---|---|---|
| 3,436,090 | 4/1969 | Lange et al. | 280/821 |
| 3,879,048 | 4/1975 | Penney | 280/821 |
| 4,004,818 | 1/1977 | Ramillion | 280/821 |
| 4,037,850 | 7/1977 | Haberlin | 280/821 |
| 4,613,156 | 9/1986 | Lajos | 280/821 |

*Primary Examiner*—Andres Kashnikow
*Assistant Examiner*—Richard M. Camby
*Attorney, Agent, or Firm*—Frank J. Dykas; Craig M. Korfanta; Ken J. Pedersen

[57] ABSTRACT

A ski pole handle (10) having cylindrical handle (12) adapted in size to be grasped around the cylindrical surface for the fingers of a grasping hand and top planar surface (19) set at a compound angle conforming to the volar surface of a thumb when the handle is grasped and the thumb rests atop ski pole handle (10). A thumb adduction splint (17) is attached to the top planar surface (19), and extends normally up therefrom. Interior surface (18) of thumb adduction splint (17) is shaped to conform to the lateral surface of the thumb resting atop planar surface (19).

1 Claim, 5 Drawing Sheets

SKI POLE HANDLE

BACKGROUND OF THE INVENTION

1. Technical Field

This invention relates to ski pole handles, and more particularly to a pair of mirror image ski pole handles which, when grasped in the hands of a skier, position the thumb atop the ski pole handle alongside a lateral adduction splint so as to preclude injury to the thumb if the skier falls.

2. Background Art

Downhill alpine skiers have traditionally used a pair of ski poles primarily as a timing device for initiating turns while skiing. Secondarily, they are used as an aid to mobility when the skier is standing, turning, or walking, as, for example, when aligning himself or herself immediately prior to sitting onto a moving ski lift chair.

As shown in prior art FIGS. 1 and 2, the traditional ski pole handle is grasped in the skier's hand as shown with the fingers wrapped around the handle and the thumb, in an opposing position. Normally, the skier's hand is gloved, but for purposes of clarity in this specification the hand is shown without a glove in all of the drawings which accompany this specification.

Also, for purposes of standardized terminology it is important to note that the thumb is anatomically identified as the first finger, the index finger as the second finger, the middle finger as the third, the traditional ring finger as the fourth, and the small finger as the fifth finger. Using these definitions, there are two normal anatomical ways of grasping an object, the first is to cup the second through fifth fingers into or toward the palm of the hand and then to wrap the thumb or first finger around the outside of the second and third fingers. This is commonly how the hand is naturally made into a fist. The second method is also equally as natural, and that is to cup the second through fifth fingers into the palm of the hand and to rest the thumb or first finger atop of the second, cupped, finger with the distal end of the thumb resting atop the lateral portion of the proximal interphalangeal joint of the second finger.

It is a common childhood experience for children learning the essentials of bare knuckles fighting, that the second type of fist, with the thumb atop of the cupped fingers, poses a particular risk of injury to the thumb if one were to strike something with a fist formed in this manner, in that the thumb could be pushed back, injuring the ligaments of the carpometacarpal joint of the thumb, which is identified in prior art FIGS. 1 and 2 as Point A.

For essentially the same reason, prior art ski handles normally provide radial top plate 21 atop prior art ski pole handle 20 to prevent the skier from positioning the thumb atop the ski pole handle.

However, an equal or perhaps greater danger presents itself if the skier positions the thumb as shown in prior art FIGS. 1 and 2, in that when a skier falls, he or she instinctively extends his or her arms and hands forward and out in front to break the impact of the fall. This exposes the skiers thumbs to the possibility of being abducted or extended away from the ski pole handle and the palm of the hand thereby damaging the thumb ulnar collateral ligaments. In fact, the tearing of the ulnar collateral ligament is one of the most common skiing related injuries, and oftentimes requires surgical repair.

During a dry land fall on an outstretched hand, the normal response is for the thumb to go into a position of adduction, protecting the ulnar collateral ligament from harmful stress. In contrast, a falling skier will continue to grasp the ski pole handles at least until the hand impacts with the snow. Therefore, the structure of any ski pole that prevents the normal adduction of the thumb and the nature of any structural member in the first web space between the thumb and the fingers, may force the thumb into abduction/extension during the fall, thus injuring the thumb ulnar collateral ligament. Even the structure taught in U.S. Pat. No. 4,613,156, which is an attempt to provide a ski pole handle which reduces damage to the ulnar collateral ligament, can, by its very structure, create situations where damage can occur. For example, a skier grasping the ski pole handle as taught in U.S. Pat. No. 4,613,156, can abduct or extend the thumb if the hand were to rotate over the top of the handle with the thumb inserted into the thumb receiving channel of the handle.

Accordingly, a primary object of this invention is to lessen and/or eliminate thumb injuries occurring during downhill skiing falls by eliminating all structure between the first web space that might act to lever the skier's thumb into abduction/extension injurious to the thumb collateral ligaments. Additionally, an adduction splint is molded onto the radial portion of the pole handle thereby preventing the skier's thumb from being forced into abduction/extension while at the same time maintaining the thumb in the protected position of adduction.

DISCLOSURE OF INVENTION

These objects are achieved by the development of a paired, mirror image, ski pole handle system for use by a skier grasping a handle in each hand. Each of the mirror image ski pole handles is provided with a generally cylindrical handle having a front elemental axis and sized for grasping by a particular skier between the four fingers of the hand in a position wherein the distal phalanges of the second through fifth fingers are held in opposition to the corresponding metacarpal bones of the palm of the hand with the proximal interphalangeal joints of the four fingers in a vertical line generally parallel and adjacent to the front elemental axis. The cylindrical handles are sized and fluted to aid the skier in locating the four fingers in the proper position.

Each cylindrical handle further has a top planar surface formed at a compound angle conforming generally to two lines on the top outside surface of said cylindrical handle, the first line being defined between the radial side of the proximal interphalangeal joint of the second, or index finger, when the handle is properly grasped between the palm and the four fingers, and the carpometacarpal joint of the thumb, and a second line defined as being transversely parallel to the volar surface of the thumb when the cylindrical handle is grasped and the distal end of the thumb rests atop the proximal interphalangeal joint of the second finger. The planar surface thus defined is at a conforming angle to that of the volar surface of the thumb when so positioned.

A cup-shaped adduction splint having an interior surface conforming generally to the shape of the lateral surface of the flexed thumb whose distal end is held adjacent and atop the radial surface of the proximal interphalangeal joint of the second, or index finger when the cylindrical handle is grasped, is attached to and extends up from the top surface of the cylindrical handle in a position on the inside of the handle such that the adduction splint interior surface is generally adjacent to the radial surface of the thumb of the grasping hand.

An extending butt plate is provided at the bottom of the handle and conveniently positioned to enable the skier to press the bottom of the hand against it when pushing off. A standard wrist strap is attached to and extends out from the butt plate for attachment around the skier's wrist to provide a convenience feature in the event that the skier lets go of the handle. The handle also is provided with a cylindrical receiving hole for frictional engagement with the end of the ski pole.

BRIEF DESCRIPTION OF THE DRAWINGS

FIGS. 6*a* and 6*b* are prospective representational top views of a right hand improved ski pole handle.

BEST MODE FOR CARRYING OUT INVENTION

Figure 2:
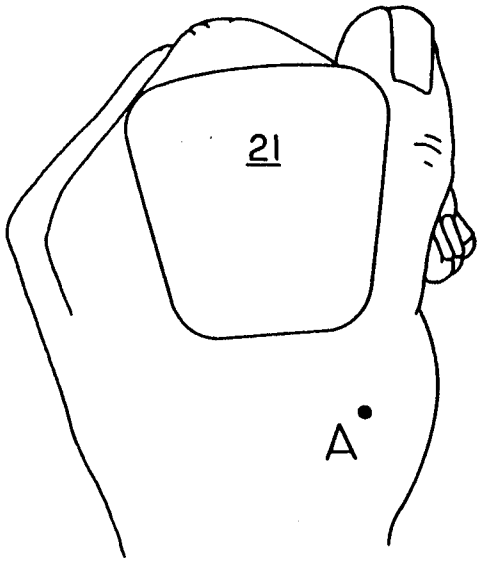
PRIOR ART FIG. 2
FIG. 2 is a top view of a skier's hand grasping a conventional, prior art, ski pole handle.
Figure 1:
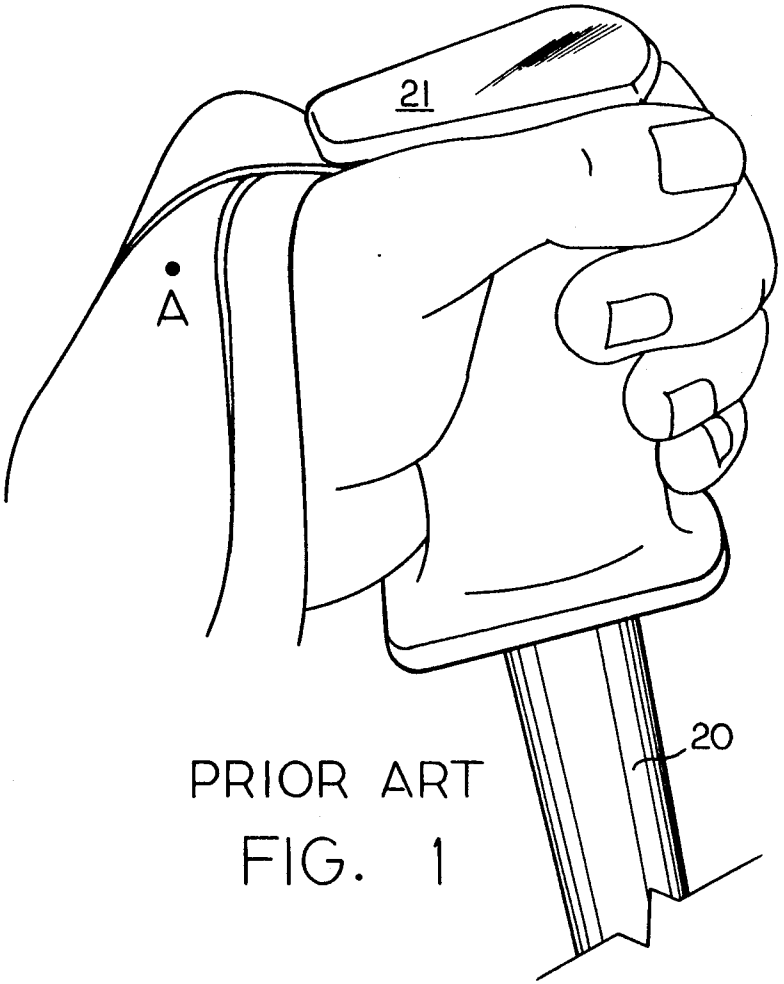
PRIOR ART FIG. 1
FIG. 1 is a perspective representational view of a conventional, prior art, ski pole handle.
Figure 3:
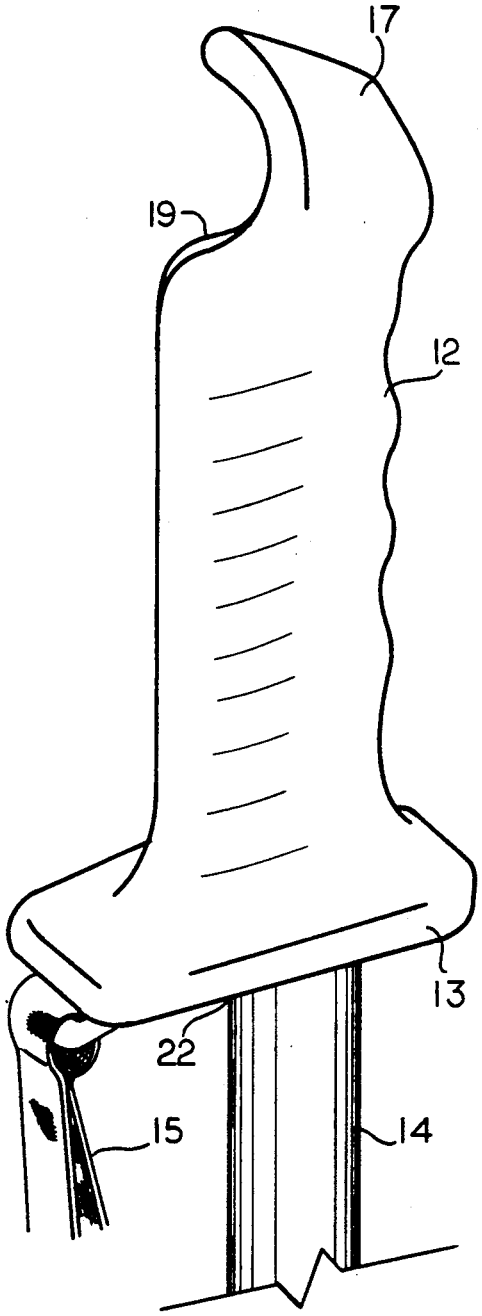
FIG. 3 is a perspective representational rear view of the improved ski pole handle.
Figure 4:
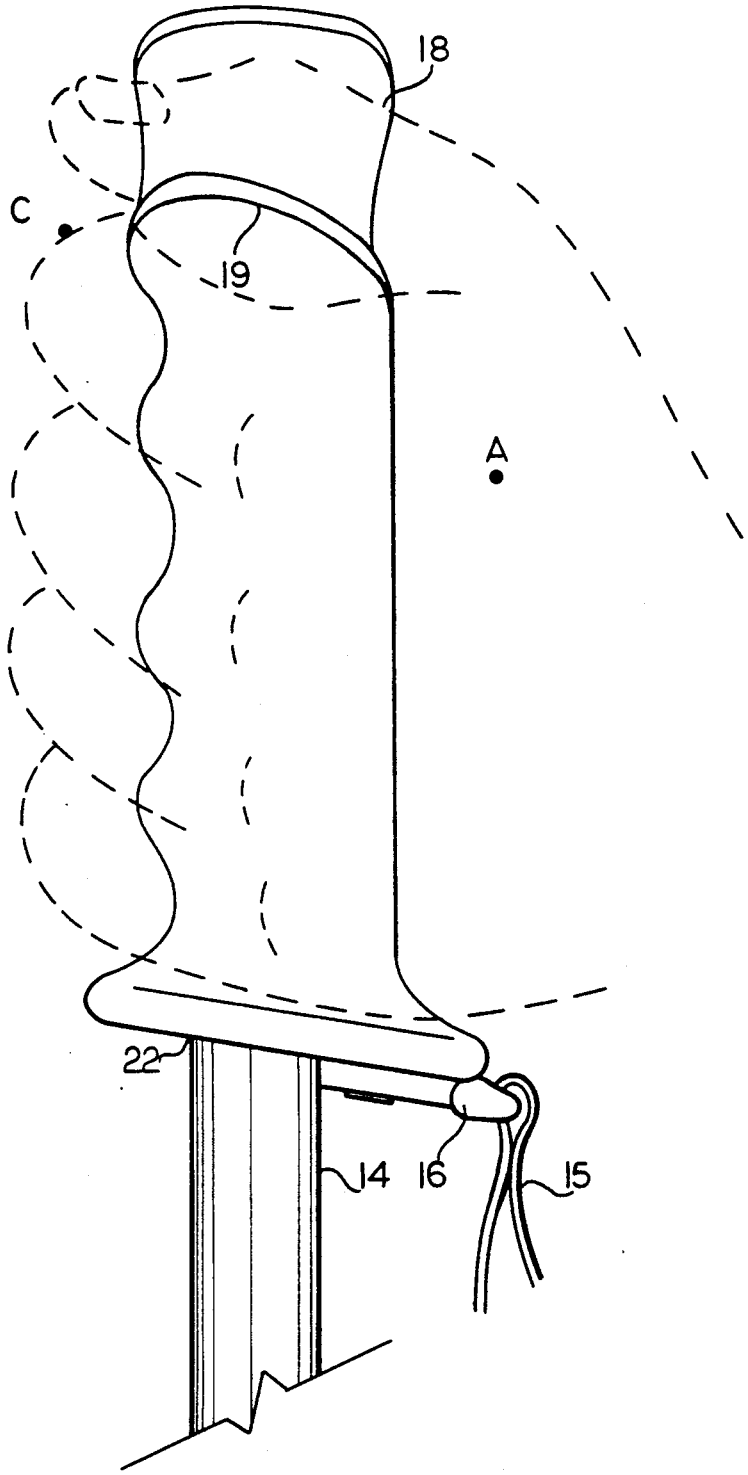
FIG. 4 is a side view of the improved ski pole handle.
Figure 5:
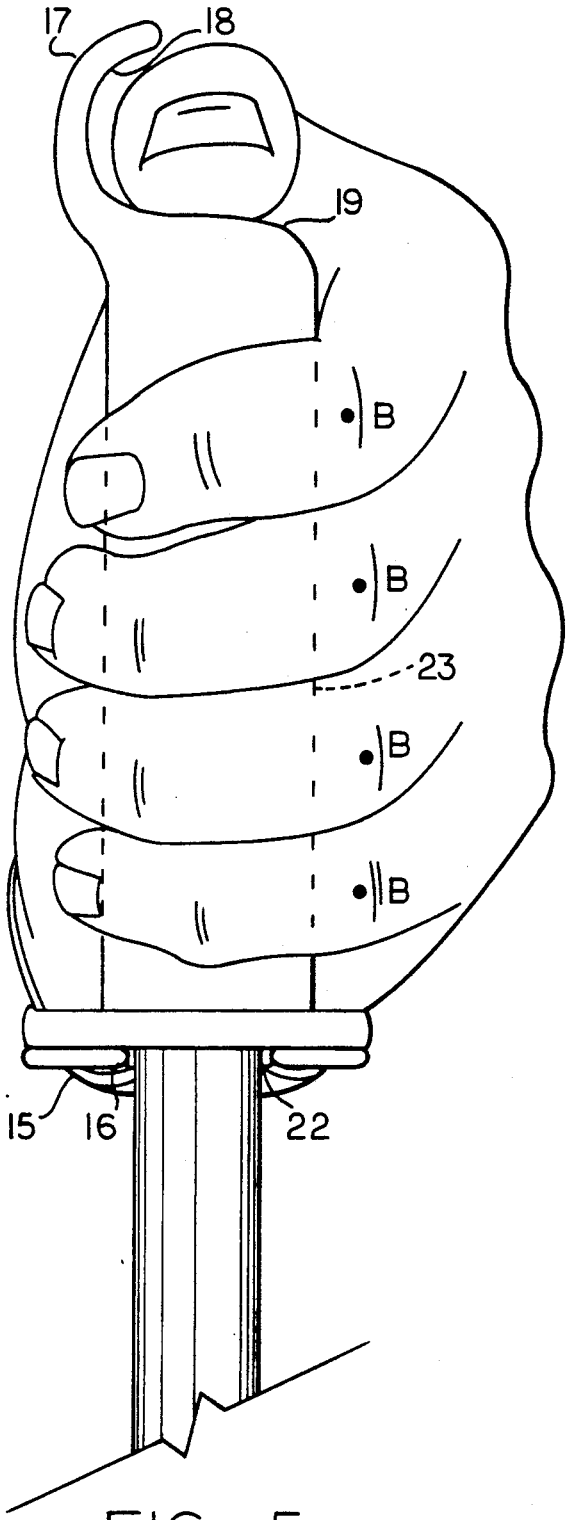
FIG. 5 is a representational front view of the improved ski pole handle.

FIGS. 3, 4, and 5, taken in combination, show the improved ski handle generally described as 10 having fluted cylindrical handle 12 The finger flutes are arranged to assist the skier in properly positioning fingers two, three, four and five around the main body of cylindrical handle 12.

Butt plate 13 is provided as a bottom rest for the skier's hand primarily to assist the skier in pushing off against ski pole 14. Ski handle 10 is attached to ski pole 14 in a conventional manner by the frictional interfit of the top end of ski pole 14 within receiving hole 22.

As shown in FIG. 5, the proper positioning of fingers two through five, results in the general vertical alignment of the proximal interphalangeal joints of fingers two through five, generally identified as Points B on FIG. 5. Also, the general alignment of the interphalangeal joints of fingers two through five is parallel and adjacent to the front elemental axis of the cylindrical handle shown as hatched line 23.

With fingers two through five properly positioned as shown in FIGS. 4 and 5, the skier is then able to rest the thumb atop planar surface 19 with the distal end of the thumb resting atop and adjacent to the lateral side of the first interphalangeal joint of the second, or index finger, which is identified as Point C. In this position, there is a line defined between the center point of the carpometacarpal joint of the thumb, identified as point A, and the radial side of the proximal interphalangeal joint of the second, or index, finger, Point C. This line intersects the top of front elemental axis 23, and along this line and a second line which is transversely parallel to the volar surface of the thumb when so positioned, is defined a compound angle across the top plane of cylindrical handle 12. Top planar surface 19 conforms to this compound angle and provides a natural resting planar surface for the volar surface of the thumb, said top planar surface being shaped to provide a smooth transition between said cylindrical handle and said top planar surface at a point adjacent a web between the skier's first and second fingers to thereby eliminate any structure therebetween.

As shown in FIG. 3, thumb adduction splint 17 extends up from cylindrical handle 12 generally normal to the compound top planar surface 19. Thumb adduction splint 17 has curved interior surface 18 which is sized and shaped to conform generally to the lateral shape of the skier's thumb when it is in an extended position and resting atop the radial portion of the proximal interphalangeal joint of the second finger.

Wrist strap 15, attached to the underside of radial butt plate 13 by means of attachment bracket 16 is also provided as a convenience feature in the event that the skier were to let go of handle 10.

Figure 6B:
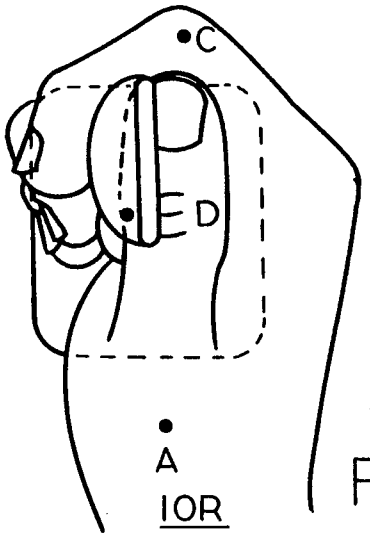
Figure 6A:
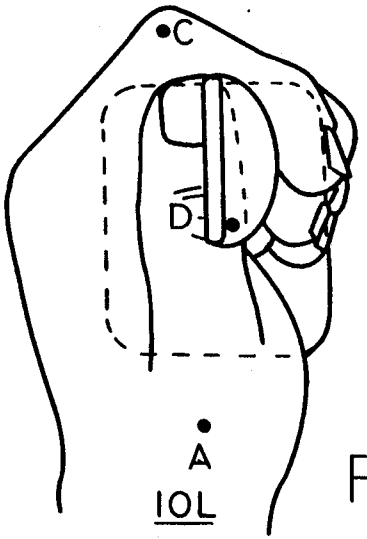
FIG. 6*a* is a representational top view of an improved left hand ski pole handle.

As shown in FIGS. 6*a* and 6*b*, the ski handles are designed to provide the skier with a pair of mirror image ski handles, 10*r* for the right hand and 10*l* for the left. Thus, if the skier were to fall and extend his or her hands forward and out to break the fall, the thumbs will be protected behind thumb adduction splints 17 when the skier's hands hit the surface of the snow.

While there is shown and described the present preferred embodiment of the invention, it is to be distinctly understood that this invention is not limited thereto but may be variously embodied to practice within the scope of the following claims.

We claim:

1. An improved ski pole handle comprising:

a generally cylindrical handle;

a cup-shaped lateral adduction splint extending up from the top inside surface of said cylindrical handle, said adduction splint having a curved interior surface shaped to conform generally to the lateral shape of a skier's thumb; and a compound top planar surface on the top outside surface of said cylindrical handle, said top planar surface being shaped to conform generally to the volar surface of a skier's thumb and said top planar surface being shaped to provide a smooth transition between said cylindrical handle and said top planar surface at a point adjacent a web between the skier's first and second fingers to thereby eliminate any structure therebetween.

* * * * *